US006962030B2

(12) United States Patent
Conn

(10) Patent No.: US 6,962,030 B2
(45) Date of Patent: Nov. 8, 2005

(54) METHOD AND APPARATUS FOR INTERCONNECTED, ROLLING RIG AND OILFIELD BUILDING(S)

(75) Inventor: Orlie Conn, Leduc (CA)

(73) Assignee: PD International Services, Inc., Calgary (CA)

( * ) Notice: Subject to any disclaimer, the term of this patent is extended or adjusted under 35 U.S.C. 154(b) by 0 days.

(21) Appl. No.: 10/265,026

(22) Filed: Oct. 4, 2002

(65) Prior Publication Data

US 2003/0066686 A1 Apr. 10, 2003

Related U.S. Application Data

(60) Provisional application No. 60/327,077, filed on Oct. 4, 2001.

(51) Int. Cl.[7] ..... E04H 1/12

(52) U.S. Cl. ..... 52/741.1; 175/57; 175/162; 166/75.11; 193/37; 52/143

(58) Field of Search ..... 175/57, 162, 202, 175/203, 206, 207, 424, 113, 122, 161, 170, 220; 166/75.11; 52/741.1, 143; 193/37, 35 R, 38, 42; 173/184; 180/14.1; 14/72.5; 414/537

(56) References Cited

U.S. PATENT DOCUMENTS

| | | | | |
|---|---|---|---|---|
| 1,103,505 A | * | 7/1914 | Grant | 193/35 R |
| 2,420,803 A | * | 5/1947 | Tobin | 52/143 |
| 4,037,662 A | * | 7/1977 | Bowling | 166/75.11 |
| 4,103,503 A | | 8/1978 | Smith | |
| 4,305,237 A | * | 12/1981 | Borg et al. | 52/143 |
| 4,324,077 A | * | 4/1982 | Woolslayer | 52/143 |
| 4,420,916 A | * | 12/1983 | Ricketts | 52/143 |
| 4,616,454 A | | 10/1986 | Ballachey et al. | |
| 4,757,592 A | * | 7/1988 | Reed | 166/75.11 |
| 4,821,816 A | * | 4/1989 | Willis | 175/57 |
| 4,823,870 A | * | 4/1989 | Sorokan | 175/202 |
| 4,899,832 A | * | 2/1990 | Bierscheid, Jr. | 173/184 |
| 5,109,934 A | * | 5/1992 | Mochizuki | 173/184 |
| 5,390,775 A | * | 2/1995 | Herrick et al. | 193/35 R |
| 5,492,436 A | | 2/1996 | Suksumake | |
| 5,533,604 A | * | 7/1996 | Brierton | 193/35 MD |
| 6,161,358 A | | 12/2000 | Mochizuki et al. | |

OTHER PUBLICATIONS

No Author, Unique Rig Fulfills Unusual Mobility Requirements, World Oil, Oct., 1989, pp. 60–61, vol. 209, No. 4, U.S.

Anonymous, Nerac.com, website printout, Jun. 22, 2000, p. 1, U.S.A.

* cited by examiner

*Primary Examiner*—David Bagnell
*Assistant Examiner*—Matthew J. Smith
(74) *Attorney, Agent, or Firm*—Mark A. Oathout

(57) ABSTRACT

A conventional land drilling rig is interconnected to the substructure for an oilfield pad location. The interconnected drilling rig is placed on top of matting. The matting has embedded rollers to facilitate movement of the drilling rig as a "convoy" across the mat from one wellhead to another wellhead. The buildings in the mud tank system may also be interconnected and move in a separate convoy but in tandem with the first convoy.

5 Claims, 4 Drawing Sheets

FIG. 1
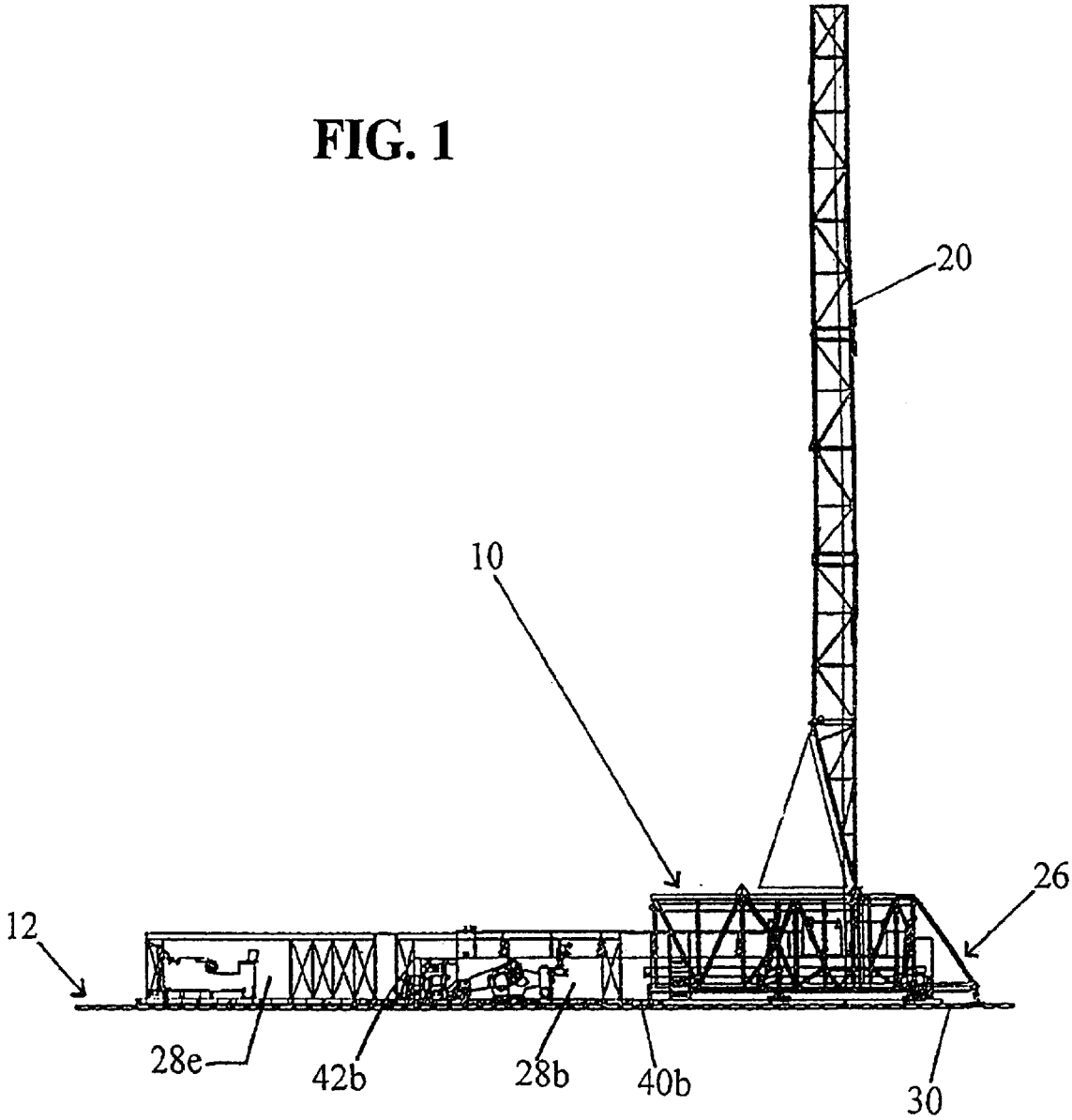
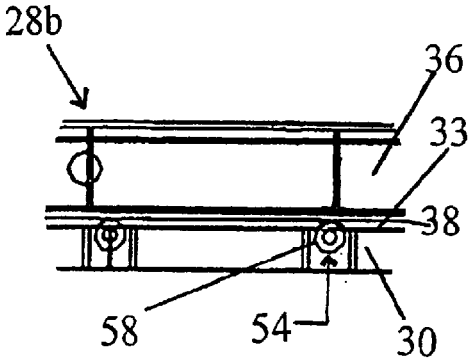
FIG. 4

METHOD AND APPARATUS FOR INTERCONNECTED, ROLLING RIG AND OILFIELD BUILDING(S)

CROSS-REFERENCE TO RELATED APPLICATIONS

This application claims the benefit of U.S. provisional application No. 60/327,077 filed Oct. 4, 2001.

STATEMENTS REGARDING FEDERALLY SPONSOR RESEARCH OR DEVELOPMENT

Not applicable.

REFERENCE TO A MICROFICHE APPENDIX

Not applicable.

BACKGROUND OF THE INVENTION

Description of the Related Art

In certain land drilling locations a number of wells are drilled from the same surface location, referred to as a "pad." The wells are drilled directionally to access oil reservoirs that extend horizontally from the pad. In order to optimize the time used to move the rig to the next well on a pad, it is necessary to skid the drilling rig from one well on the pad to another well location on the same pad. The distance between the wells on the same pad varies but can, for example, be in the order of about ten meters.

The land drilling rig used for drilling wells on the pad is comprised of a number of support modules containing such equipment as engines, mud pumps, accumulator, etc. The associated support modules or machinery are typically mounted on steel skids.

In the past, the movement of the drilling rig was facilitated by splitting the module into two different parts. One part (consisting of the substructure, mast, doghouse, transfer mud tank, and catwalk) was the mobile unit that was dragged from well to well. The second part (consisting of mud pumps, generators, electrical, central mud system) was spotted permanently on the pad location. These two parts are linked with the use of suitcases (an umbilical-cord like connection comprised mainly of cables and hoses). Large lease locations, difficulties in transferring gasified mud, the need to construct a pad-specific rig, and unpolished move times suggested the need for improvements.

BRIEF SUMMARY OF THE INVENTION

A conventional land drilling rig is slightly modified to adapt for efficient pad drilling. The conventional land drilling rig is interconnected to form a somewhat rigid convoy. The interconnected drilling rig is placed on top of matting. The matting has rollers to facilitate movement of the drilling rig as a "convoy" across the matting from one wellhead to another wellhead in pad-type work. The tanks in the mud system may also be interconnected and placed on top of a matting having rollers for moving the mud tank system as a separate convoy but in tandem with the first convoy.

BRIEF DESCRIPTION OF THE SEVERAL VIEWS OF THE DRAWINGS

FIG. 1 is a profile view of a typical drilling rig placed on matting.

FIG. 4 is a blown up view taken from the lower-middle portion of FIG. 1

DETAILED DESCRIPTION OF THE INVENTION

Figure 2:
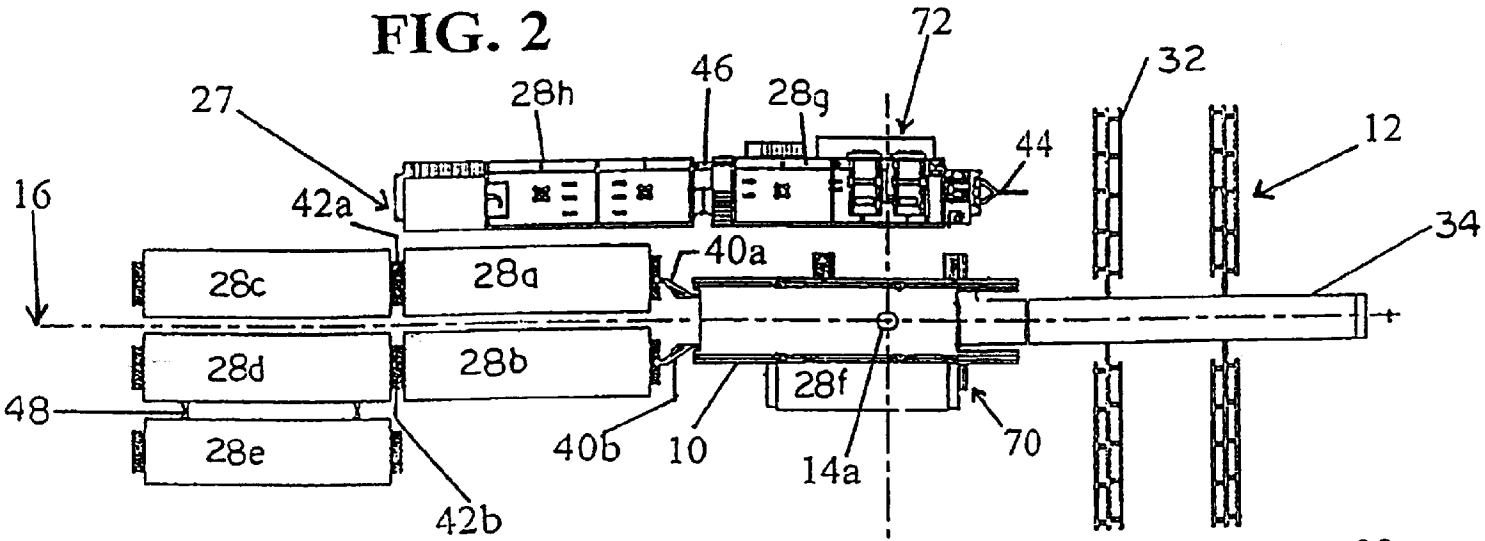
FIG. 2 is a plan view of the drilling rig on a typical well-cluster pad.
Figure 3:
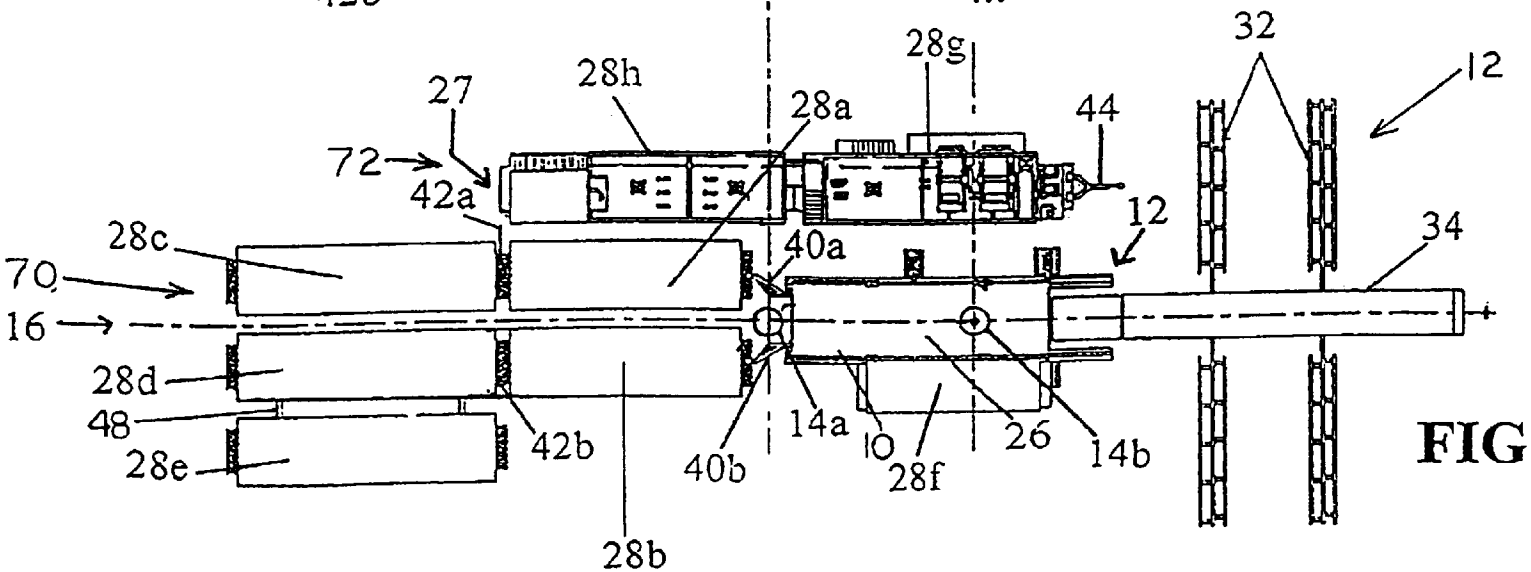
FIG. 3 is a view similar to FIG. 2 but shows the drilling rig after a skid with respect to the positioning of the drilling rig in FIG. 2.

Referring to FIGS. 1–3 a drilling rig 10 is shown for a cluster of wells with wellheads 14*a* and 14*b* (there may be several more wells located along the well line 16 of the wells). The drilling rig 10 and oilfield buildings 28*a–f* are converted into an integral system or convoy 70.

Figure 3A:
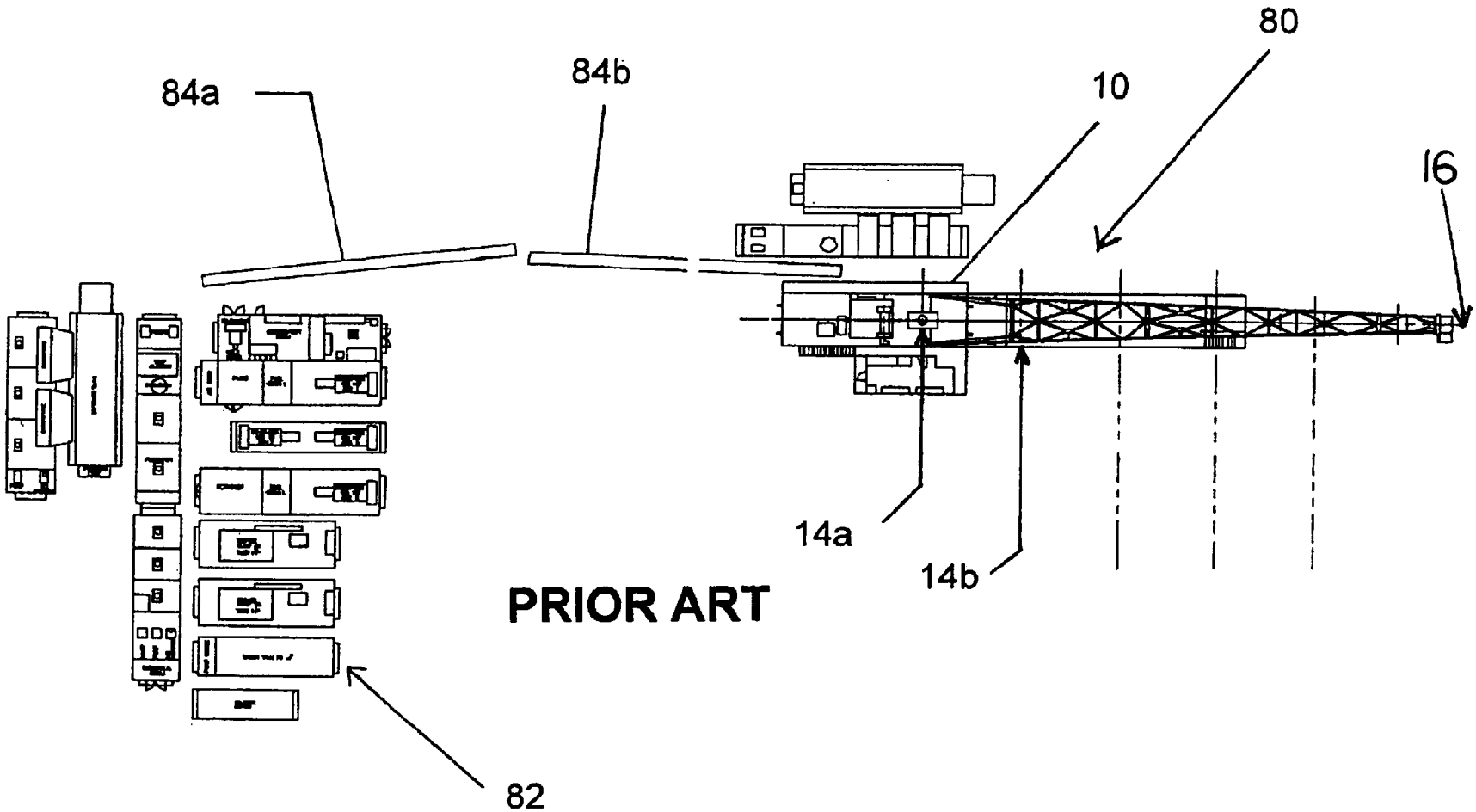
PRIOR ART FIG. 3A
FIG. 3A is a plan view of a prior art drilling rig for pad work.
Figure 5:
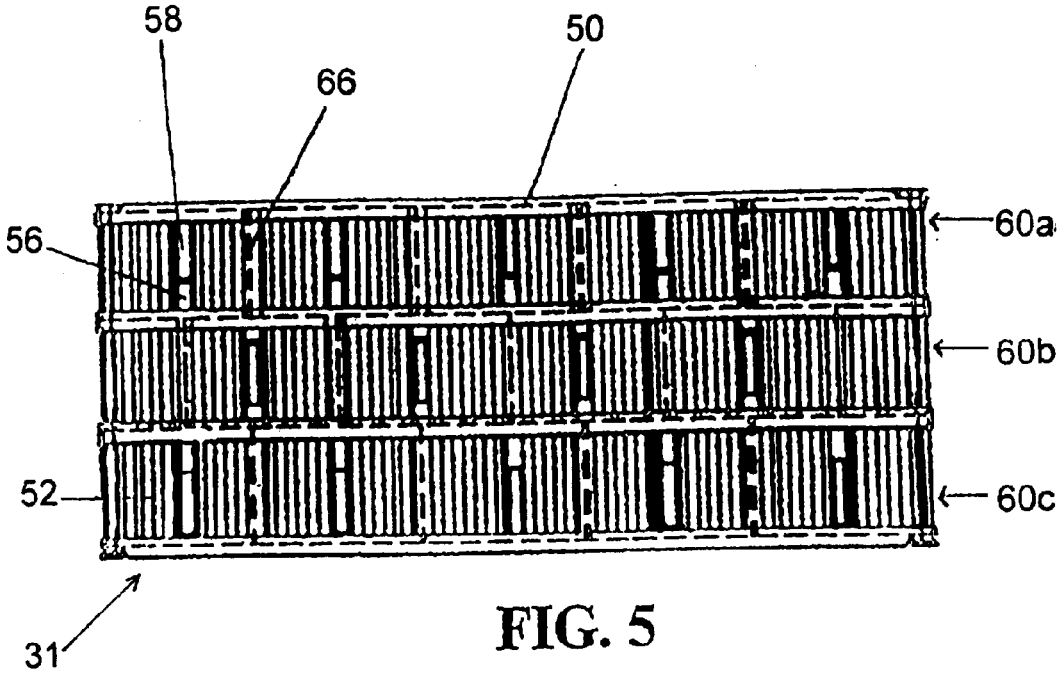
FIG. 5 is a profile view of the mat with rollers.
Figure 6:
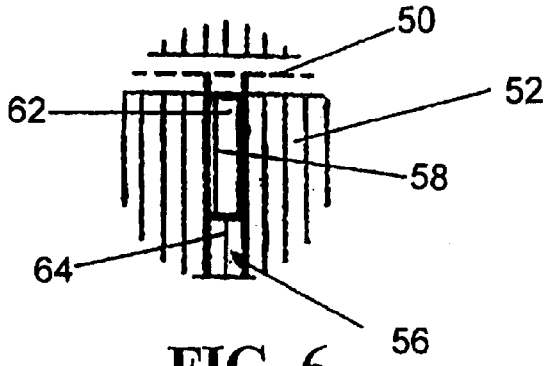
FIG. 6 is a top detail view of a roller in the mat.
Figure 7:
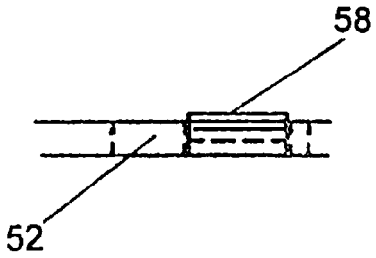
FIG. 7 is a side, detail view of a roller in the mat.

For comparison, a prior art land drilling rig 10 for pad work is shown in FIG. 3A. The prior art drilling rig 10 with wellheads 14*a,* 14*b,* etc. has a mobile complex 80 which is separate from a stationary complex 82. The mobile complex moves along the well line 16. The stationary complex 82 is set to the side of the drilling location and includes several oilfield buildings. Suitcases 84*a,* 84*b* (typically, more than two are utilized) carry electrical cables and mud hoses (both not shown) from the stationary complex 82 to the varying location of the mobile complex 80.

Referring back to FIGS. 1–3, the land drilling rig 10 of the present invention, in one embodiment, generally includes a mast/crown 20, a substructure 26, a catwalk 34, pipe racks 32, doghouse 28*f,* mud pumps 28*a* & 28*b,* generator buildings 28*c,* 28*d* & 28*e,* matting 30, and mud tanks 28*g* & 28*h*. All modules that sit behind the substructure will be referred to as oilfield buildings 28*a, b, c, d, e,* etc.

In other land drilling rig arrangements, several other types of oilfield buildings (generally designated by reference number 28) may be incorporated including additional pump houses, water tanks, tool houses, boilers, fuel tanks, storage buildings, change house, accumulator and generators. The buildings 28 may be any of at least some of the preceding types of oilfield buildings 28 and only one representative oilfield building 28 arrangement is shown in the drawings.

Referring to FIGS. 1 and 4, the oilfield buildings 28 are generally of steel construction and are mounted on steel support skids 36 (made of runners 38) for structural support and transporting the buildings 28 by way of truck.

Referring to FIGS. 1–3, the substructure 26 and oilfield buildings 28 are converted into an integral system or convoy 70 for the purpose of moving the entire drilling rig 10 along the matting 30 form the current well 14*a* to the next well 14*b*. This is accomplished by interconnecting the substructure 26 and the oilfield buildings 28*a–e* to form a convoy 70 (note building 28*f* rests on top of the substructure 26). The oilfield buildings 28*a–e* are interconnected in both the "driller to-off-driller direction" and the "length of the drilling module direction."

Two reinforced arms 40*a, b* are attached on one end to the rear of the substructure 26 and the other end to the front of the oilfield buildings 28*a* and *b*. The arms 40*a* and *b* may be made of steel and are pinned in place. Connectors such as short connector plates 42*a* and 42*b* may be made between the skid 36 pick up rolls of longitudinally adjacent buildings 28. For example, the rear of building 28*a* may be attached to the front of building 28*c* by connector plates 42*a*. Connector plates 42*a* and *b* may be made of steel and may be attached by pinning or welding.

Lateral connectors 48 extend to auxiliary buildings, for example to the side of building 28*e*. The lateral connectors 48 may be steel bars or plates attached by pinning or welding between adjacent buildings.

Lateral connections made between buildings 28*a* and 28*b* and between the buildings 28*c* and 28*d* must be such that there is no interference with the existing line of wellheads 14 that pass between the buildings 28. A connection would be made between such buildings at a level above the top of the wellheads 14.

The mud system 27, with mud tanks 28*h* & 28*g*, may be made into a separate interconnected system or second convoy 72 for purposes of independently moving the mud system 27. A hydraulic arm 44 is attached to the front of mud tank 28*g*. This hydraulic arm would then pull the mud tank convoy 72 by inserting the front of the hydraulic arm 44 into the available roller-pockets 56 in the matting 30. Another short connector 46 similar to short connectors to 42*a* and *b* may be made between buildings 28*g* and 28*h*.

Referring more specifically to FIGS. 4–7, the matting 30 for the support of the drilling rig 10 is fabricated to form a mobile foundation for the drilling rig 10. Matting 30 is preferably a rigid or steel framework 31 constructed of longitudinal beams 50 with perpendicular support bars 52. An example of standard sized mat is 25 feet long, by 9 feet wide, by 6 inches in depth. The mat 30 has housings/frames 54 for the mounting of rollers 58. The housing 54 provides an opening/roller-pocket 56 for the roller 58. The rollers 58 protrude above the top surface 33 of the mat 30. In the embodiment shown in the drawings there are three row type formations 60*a, b* and *c* (the number of rows corresponds with the number of runners 38 on the skids 36). Rows 60*a* and *c* in the embodiment shown in the drawing have five rollers along the edges of the mat 30. The center row 60*b* has four rollers staggered between the rows 60*a* and *c*. As such, the mat 30 is designed such that the rollers 58 are evenly distributed over the area of the surface of mat 30.

The rollers 58 (fourteen in number in the embodiment shown FIG. 5) mounted in the mat 30 are, by way of example, 18" long with a 4.5" diameter and protrude 2" above the top surface 33 of the mat 30. The rollers 58 have a pipe 62 that forms the roller portion of the roller 58, a center shaft 64 and internal bearings/bushings (not shown). The center shaft 64 is mounted in the roller housings 54 (in the above example, the center shaft 64 is mounted 0.25" below the top surface 33 of the mat 30 for a two inch protuberance above the top surface 33). The rollers are removable from the housings 54. If no roller 58 is mounted in an opening 56, then the opening 56 should be covered with, for example, a steel plate 66. Other forms of rollers such as, for example, HILLMAN rollers (not shown) could be implemented in the invention. Rollers could also be implemented into the runners 38.

The rollers 58 support the weight of the entire drilling rig 10 (i.e. the entire convoy 70 or 72) and eliminate most of the shear friction force created when the substructure 26 and buildings 28 are moved across the mat 30. This movement is in the nature of a rolling motion across the matting 30 as opposed to a skidding motion. Moreover, due to the interconnections between the substructure 26 and the buildings 28, the entire first convoy 70 can be moved in unison from one wellhead 14*a* to the next wellhead 14*b* as seen when comparing FIG. 2 to FIG. 3. Movement is imparted by "pulling" or applying a tensile force to the convoy 70. Propulsion may be originated at a variety of locations along the lower sides of the substructure 26. The result is a much faster and efficient method of moving the convoy 70 from one well to the next on pad 12 locations. This concept eliminates the need to transfer gasified drilling fluid to a centralized mud system (as typically done on pad locations) and introduces a method of transforming a conventional land drilling rig into a rig capable of very efficient pad work.

Due to the large weight of the mud system 27 relative to the rest of the drilling module and their unbalanced position relative to the line of wellheads 14, it is preferable to move the mud system 27 separate from the substructure 26 and trailing buildings 28*a* through *e*. Movement of the mud tank 28*g*. *h*, i.e. the second convoy 72, mimics the movement of the first convoy 70 through the hydraulic arm 44 which is mounted on the front end of mud tank 28*g*. It was discovered that "driller-to-off-driller" side misalignment was minimized by separating the movement between the two convoys 70 and 72.

I claim:

1. A method for moving a drilling rig from one well location on a pad to a second well location on the pad, comprising:

moving the drilling rig over a matting including a plurality of rollers;

connecting a plurality of oilfield buildings to a substructure prior to said moving step; and independently moving a mud rank system over the matting.

2. The method of converting a conventional land drilling rig from a drilling rig designed for one-hale pads to a drilling rig capable of performing very efficient multi-well pad drilling, comprising the steps of:

interconnecting a substructure and a plurality of oilfield buildings;

placing the substructure and the plurality of oilfield buildings on a matting including a plurality of rollers; and after said interconnecting and said placing steps are performed, moving the substructure and the plurality of oilfield buildings along the matting from one well head to another well head.

3. A method for moving a drilling rig from one well location on a pad to a second well location on the pad, comprising:

making a matting with a plurality of rollers;

moving the drilling rig over the matting wherein the drilling rig includes a plurality of oilfield buildings and a substructure; and connecting the plurality of oilfield buildings to the substructure prior to said moving step.

4. A method for moving a drilling rig from one well location on a pad to a second well location on the pad, comprising:

moving the drilling rig over a matting including a plurality of rollers; and independently moving a mud tank system over the matting.

5. A mat for an oilfield pad location, comprising:

a rigid framework having a plurality of housings and a plurality of openings; and a plurality of rollers wherein said rollers have a pipe shape and wherein said rollers are mounted in the housings and in the openings wherein said rollers have a diameter causing said rollers to protrude above a top surface of the mat a substructure and first, second and third oilfield buildings mounted on the mat;

an arm connected between a rear of the substructure and a front of the first oilfield building;

a connector connected between a rear end of the first oilfield building and a from end of the second oilfield building; and a lateral connector connected between a side of the second oilfield building and another side of the third oilfield building.

* * * * *